US011021294B2

(12) United States Patent
Hogan

(10) Patent No.: US 11,021,294 B2
(45) Date of Patent: Jun. 1, 2021

(54) DISPENSING CONTAINERS

(71) Applicant: MEDI-Clear Ltd, Hull (GB)

(72) Inventor: Mark Paul Hogan, Hull (GB)

(73) Assignee: MEDI-Clear Ltd, Hull (GB)

( * ) Notice: Subject to any disclaimer, the term of this patent is extended or adjusted under 35 U.S.C. 154(b) by 81 days.

(21) Appl. No.: 16/507,154

(22) Filed: Jul. 10, 2019

(65) Prior Publication Data

US 2019/0329933 A1 Oct. 31, 2019

Related U.S. Application Data

(63) Continuation of application No. 15/950,468, filed on Apr. 11, 2018, now abandoned.

(30) Foreign Application Priority Data

May 4, 2017 (GB) ..... 1707077

(51) Int. Cl.
*B65D 17/28* (2006.01)
*B65D 75/32* (2006.01)
*A61J 1/03* (2006.01)

(52) U.S. Cl.
CPC ..... *B65D 17/401* (2018.01); *B65D 75/327* (2013.01); *A61J 1/035* (2013.01);
(Continued)

(58) Field of Classification Search
CPC ..... B65D 17/401; B65D 75/327; B65D 2401/00; B65D 2401/10;
(Continued)

(56) References Cited

U.S. PATENT DOCUMENTS 5,046,618 A * 9/1991 Wood ..... B65D 75/327 206/532
5,346,301 A 9/1994 Scarberry et al.
(Continued)

FOREIGN PATENT DOCUMENTS

EP 1695921 A2 8/2006
EP 3025697 A1 6/2016
(Continued)

OTHER PUBLICATIONS

Combined Search and Examination Report for Great Britain Application No. GB1707077.2, published by the United Kingdom Intellectual Property Office, dated Nov. 7, 2017, 7 pages.
(Continued)

*Primary Examiner* — Rafael A Ortiz
(74) *Attorney, Agent, or Firm* — Kilyk & Bowersox, P.L.L.C.

(57) ABSTRACT

A seal that forms part of a container for storing and dispensing consumer products is provided. The container can be used for the packaging of pills, tablets or capsules, or as a multi-cavity container for organizing and storing mixed medication for subsequent dispensation according to a predefined dosage regimen. The seal includes a cover film and a barrier film. The cover film has pre-formed lines of separation defining a removable portion per cavity. The barrier film is secured to the cover film by a layer of peelable adhesive and has pre-formed lines of separation defining the periphery of a barrier patch per removable portion. The cover film includes a tamper-indicating line of separation close to an edge of the cover film that is designed to tear if an attempt is made to peel the cover film away from the tray to expose one or more of the cavities.

11 Claims, 6 Drawing Sheets

(52) U.S. Cl.
CPC ..... *B65D 2401/00* (2020.05); *B65D 2401/10* (2020.05); *B65D 2575/3236* (2013.01); *B65D 2585/56* (2013.01)

(58) Field of Classification Search
CPC ..... B65D 2575/3236; B65D 2585/56; B65D 2101/0015; A61J 1/035
USPC ..... 206/538, 807, 484, 484.1, 484.2, 469, 206/531, 532, 539; 229/102
See application file for complete search history.

(56) References Cited

U.S. PATENT DOCUMENTS

| | | | | |
|---|---|---|---|---|
| 5,360,116 | A * | 11/1994 | Schmiletzky | B65D 75/326 206/531 |
| 6,705,467 | B1 | 3/2004 | Kancsar et al. | |
| 7,389,906 | B2 * | 6/2008 | Sih | B65D 27/00 229/71 |
| 7,624,872 | B2 | 12/2009 | Elliott | |
| 7,984,807 | B2 | 7/2011 | Elliott | |
| 7,987,989 | B2 | 8/2011 | Abell | |
| 2005/0087472 | A1 * | 4/2005 | Elliott | B65D 83/0445 206/528 |
| 2007/0205132 | A1 | 9/2007 | Bouthiette | |
| 2010/0213092 | A1 * | 8/2010 | Swain | B65D 75/5833 206/459.5 |
| 2011/0083975 | A1 * | 4/2011 | McGrane | B65D 75/20 206/1.5 |
| 2013/0299499 | A1 * | 11/2013 | Elliott | B65D 75/327 220/359.1 |
| 2018/0079248 | A1 * | 3/2018 | Pascua | B65D 85/00 |
| 2018/0319533 | A1 | 11/2018 | Hogan | |

FOREIGN PATENT DOCUMENTS

| | | | |
|---|---|---|---|
| GB | 2416758 | A | 2/2006 |
| WO | 9618555 | A1 | 6/1996 |
| WO | 2005023670 | A1 | 3/2005 |
| WO | 2012049446 | A1 | 4/2012 |
| WO | 2012049447 | A1 | 4/2012 |
| WO | 2012136989 | A1 | 10/2012 |

OTHER PUBLICATIONS

Combined Search and Examination Report for Great Britain Application No. GB2004171.1, published by the United Kingdom Intellectual Property Office, dated Sep. 4, 2020, 6 pages.

* cited by examiner

DISPENSING CONTAINERS

CROSS-REFERENCE TO RELATED APPLICATIONS

This application is a continuation of U.S. patent application Ser. No. 15/950,468, filed Apr. 11, 2018, which claims priority to Great Britain Patent Application No. 1707077.2 filed on May 4, 2017, all of which are incorporated herein by reference in their entities.

FIELD OF THE INVENTION

The invention relates to containers for storing and dispensing consumer products. The term consumer products is intended to cover a wide variety of products as illustrated by the following (non-exhaustive) list: foods, either for immediate consumption, pre-cooked, prepared or oven ready, including prepared meals, confectionary, hardware and do-it-yourself (DIY) items, cosmetics, seeds, animal and fish feeds, electronic components, medical appliances and dressings, medicines and medication such as pills, tablets, and capsules.

The containers may be used in place of conventional blister packs for the packaging of pills, tablets and capsules, or may be used for organizing and storing mixed medication for subsequent dispensation according to a predefined dosage regimen. The principle behind such mixed medication containers is that a dosage regimen of mixed medication can be organized in advance for a period of a week or more, and a patient or nurse can then remove from the container, at predefined times over the said period, the one or more pills, tablets and/or capsules to be administered on each occasion according to the dosage regimen.

BACKGROUND TO THE INVENTION

Blister packs are of course well known for the storage and dispensing of pills, tablets and capsules, which are stored individually in cavities in a multi-cavity tray and removed by pushing each pill, tablet or capsule through a rupturable film or foil covering the cavities. The film or foil cover may be paper or a plastics film that can be peeled or torn away to expose the medication in the tray cavities, but is generally aluminum foil, which has the dual advantage of being easily rupturable and vapor-impermeable. Such blister packs normally carry only one-unit dose of the same medication in each cavity.

Mixed medication blister packs have been proposed, having larger cavities for filling by a pharmacist, wherein each cavity in a multi-cavity tray can be filled with a mixture of medications. Typically, a tray may have a 2×7, 3×7, 4×7 or 5×7 array of cavities corresponding to 2, 3, 4 or 5 predefined medication times per day over a 7-day period, or one dose prescribed per day over a 2, 3, 4, or 5-week period. For example, a 4×7 tray may be filled with the medication to be taken at breakfast-time, lunchtime, early evening and immediately before retiring each day for a week, and then the filled cavities sealed with a rupturable or sequentially rupturable film or foil cover. Printed instructions on the pack identify the intended sequence of opening the individual cavities to dispense their contents according to the prescribed dosage regimen.

Disadvantages of conventional blister packs using a rupturable cover sheet are the difficulty experienced by some patients, particularly the elderly, in pushing the medication through the cover sheet, the need for expensive laminating equipment to seal the aluminum cover sheet over the cavities after the initial filling, and the difficulty experienced by the user in selecting the cavity containing the medication to be dispensed if the medication is pushed up through the foil from below. If the wrong cavity is opened by mistake, then re-sealing is impossible because the cover sheet has ruptured.

A major disadvantage of the blister pack using a peelable cover sheet is the difficulty experienced by the user in peeling or tearing away a single selected portion of the cover sheet to expose the contents of only one preselected cavity. This can be achieved by scraping a finger-nail over a corner or tab portion of a segment of the cover sheet sealing the preselected cavity but grasping that corner to peel away the complete segment sometimes requires considerable manual dexterity and possibly good eyesight, which is beyond the abilities of many elderly users. Also, if a tacky peelable adhesive is used to adhere the cover sheet to the tray, it is desirable to prevent the contents of the tray from coming into contact with the adhesive. Finally, the film cover sheet may not have as high a vapor impermeability as metal foil, so there is a reluctance on the part of pharmacists to pre-fill a mixed medication blister pack with medication for administration more than seven days in advance of the filling date, lest the medication deteriorates due to storage in humid ambient conditions.

WO 2005/023670 describes a container that aims to overcome some or all of the above problems and disadvantages. The container is for storing and dispensing consumer products and includes a tray having a generally planar top surface into which has been formed one or more discrete cavities for receiving the consumer products. A cover film is adhered to the generally planar top surface of the tray by a layer of peelable adhesive to seal the one or more cavities to retain the consumer products in the one or more cavities. The cover film has pre-formed tear lines defining a tear-off portion per cavity to retain the consumer products in that cavity until it is removed by tearing along its tear lines. In practice it will be readily appreciated that the or each tear-off portion can also be defined by cut lines extending completely through the material of the cover film. The or each tear-off portion of the cover film has low vapor transmission properties in the area which in use overlies the associated cavity, those low vapor transmission properties being created by a barrier patch with high vapor barrier properties shaped and sized to overlie the associated cavity. The or each barrier patch is adhered to the underside of the cover film by the same layer of peelable adhesive as that which adheres the cover film to the top surface of the tray.

The barrier patch beneath the or each tear-off portion can be created from a single sheet of barrier film as follows. A single sheet of barrier film is secured to the underside of the cover film by a peelable adhesive. The barrier film has pre-formed tear-lines defining the periphery of the or each vapor-resistant barrier patch so that peeling away the majority of the barrier film from the cover film immediately prior to application of the cover film to secure it to the generally planar top surface of the tray exposes the peelable adhesive in areas necessary for adhesion to the tray but leaves a barrier patch attached to the underside of the or each tear-off portion of the cover film. In practice it will be readily appreciated that the or each barrier patch can also be defined by cut lines extending completely through the material of the barrier film.

The sheet of barrier film can have a further pre-defined tear line (or cut line) close to one edge thereof to define a tear-off strip which when removed exposes a location anchorage area of the peelable adhesive on the underside of the cover film, for adhering an edge portion of the cover film to an edge portion of the tray before peeling away the majority of the barrier film and adhering it over the cavities. To assist in the process of adhering the cover film to the top surface of the tray, the tray can have upstanding cover film location means. The cover film can have cooperating means for accurate location of the cover sheet over the tray with the one or more cavities and associated tear-off portions in register before adhering the cover film to the tray.

It will be readily appreciated that WO 2005/023670 describes a "cold seal" process where the cover film is secured to the tray by the same layer of peelable adhesive that is used to secure the cover film to the barrier film. After the majority of the barrier film has been peeled away from the cover film to expose the peelable adhesive, the cover film can be secured manually to the top surface of the tray.

It is important that the contents of the cavities are not tampered with. This is particularly true in the case where the container is used to store foods, animal and fish feeds and medication etc. where such tampering can have serious health consequences. One way a container can be tampered with is by inserting a blade or other sharp object underneath the cover film to try and gently peel it away from the tray without it rupturing. If the cover film can be peeled away carefully to expose one or more of the underlying cavities, the respective contents can be removed and replaced or otherwise interfered with. There is a risk that the cover film can then be re-secured to the tray in such a way that the tampering is not immediately visible to the user.

SUMMARY OF THE INVENTION

The present invention provides an improved seal for use with a container for storing and dispensing consumer products comprising a tray having a generally planar top surface into which has been formed one or more discrete cavities for receiving the consumer products, the seal comprising:

- a cover film to seal the one or more cavities to retain the consumer products in the one or more cavities when secured to the generally planar top surface of the tray, the cover film having pre-formed lines of separation defining a removable portion per cavity;
- wherein the cover film includes a pre-formed tamper-indicating line of separation formed in the part of the cover film that lies outside the one or more removable portions.

Forming the tamper-indicating (or security) line of separation in the part of the cover film that lies outside the one or more removable portions ensures that the tamper-indicating line of separation does not interfere with the lines of separation in the cover film that define the or each removable portion and which allow the or each removable portion to be released from the remainder of the cover film so that the contents of the underlying cavity can be dispensed through the newly-created opening. If the cover film includes an array of removable portions, the tamper-indicating line of separation can be formed in a peripheral part of the cover film between the array of removable portions and an edge of the cover film.

The tamper-indicating line of separation can extend along an edge of the cover film.

The tamper-indicating line of separation can be adjacent to or close to an edge of the cover film. For example, the tamper-indicating line of separation can be positioned a few millimeters in from the edge of the cover film so that it tears if a blade or other sharp object penetrates only a short distance between the cover film and the generally planar top surface of the tray.

The tamper-indicating line of separation can have any suitable length and shape, e.g., straight, wavy, zig-zag etc. The tamper-indicating line of separation can be defined by a plurality of individual cut or pre-scored lines or by a plurality of straight or curved line segments. The tamper-indicating line of separation can extend substantially parallel to an edge of the cover film. In one arrangement, the line segments close in a loop to define a closed polygonal tamper-indicating line of separation that can enclose at least one of the removable portions. Such a tamper-indicating line of separation can extend completely around the cover film adjacent to or close to each edge of the cover film.

The cover film can include a plurality of tamper-indicating lines of separation. One or more additional tamper-indicating lines of separation can be formed in a central part of the cover film between the rows or columns of an array of removable portions or can extend along respective edges of the cover film, for example. The tamper-indicating lines of separation can be substantially parallel to each other to provide additional security against tampering or deliberate interference with the integrity of the cover film.

The tamper-indicating line(s) of separation should not degrade the overall integrity of the cover film or seal as a whole, e.g., in terms of its ability to maintain closure of the cavities, vapor permeability etc.

The cover film is designed to tear along the tamper-indicating line of separation if an attempt is made to remove the cover film from the tray, e.g., by inserting a blade between an edge of the cover film and the generally planar top surface of the tray to gently peel the cover film away from the tray. If the cover film is torn along the line of separation, it provides a clear visual indicator to the user that the seal has been tampered with.

Each tamper-indicating line of separation can be defined by a pre-scored or pre-perforated tear line, or a combination thereof. The pre-scored tear line may be created by cutting or scoring part way through but not fully through the thickness of the cover film. The depth of the pre-scored tear lines or the size and shape of the individual perforations of the pre-perforated tear lines can be determined to provide the right amount of resistance to separation. Increasing the resistance to separation can reduce the likelihood of the tamper-indicating line of separation tearing when the optional barrier film (see below) is removed from the cover film and/or when the cover film is secured to the generally planar top surface of the tray by a manual or automated process. But the resistance to separation should not be too high such that it impedes the tearing of the cover film along the tamper-indicating line of separation if tampering or interference takes place.

The seal can include a barrier film secured to the cover film, the barrier film having pre-formed lines of separation defining the periphery of a barrier patch per removable portion that is shaped and sized so that in use it overlies an associated cavity.

The barrier film can be secured to the cover film by a layer of peelable adhesive and the seal can be secured to the tray using a conventional "cold seal" process where the majority of the barrier film is peeled away to expose the peelable adhesive.

The periphery of the or each removable portion can be defined by a pre-formed cut line extending completely through the material of the cover film, a pre-scored or pre-perforated tear line, or any combination thereof. Similarly, the periphery of the or each barrier patch can be defined by a pre-formed cut line extending completely through the material of the barrier film, a pre-scored or pre-perforated tear line, or any combination thereof. The pre-scored tear lines may be created by cutting or scoring part way through but not fully through the thickness of the cover film or barrier film.

The or each removable portion of the cover film can retain the consumer products in the associated cavity until it is removed or released from the remainder of the cover film along its line of separation. The depth of the pre-scored tear lines or the size and shape of the individual perforations of the pre-perforated tear lines can be determined to provide the right amount of resistance to separation for any given application. Increasing the resistance to separation can reduce the likelihood of the removable portions being removed accidentally or being pushed into the discrete cavities of the underlying tray if, for example, dispensing containers are stacked one on top of the other. The pre-scored tear lines, pre-perforated tear lines and cut lines can be formed using a rotary die cutter or the like. A rotary die cutter or the like can also be used to form the tamper-indicating line of separation in the cover film.

The line of separation defining the or each removable portion can extend completely around the periphery of the associated cavity, and only within the periphery of the associated barrier patch. Alternatively, the or each removable portion can be attached to the remainder of the cover film by a bridge region such that the associated line of separation does not extend completely around the periphery of the associated cavity. The removable portion will therefore remain attached to the cover film after it has been released and the contents of the cavity have been dispensed. This arrangement is considered to be more environmentally friendly because the individual removable portion and associated barrier patch do not have been discarded each time the contents of a cavity are dispensed.

In a preferred arrangement of the invention, the pre-formed line of separation defining the periphery of the or each barrier patch lies outside the pre-formed line of separation defining the periphery of the overlying removable portion such that the barrier patch is larger than the associated removable portion. In this case the barrier patch can overly a narrow border or region of the generally planar top surface of the tray extending completely around the periphery of the associated cavity in use. The barrier patch must also be peeled away from a narrow border of the cover film immediately outside the line of separation defining the periphery of the removable portion when the overlying removable portion is released. If the pre-formed line of separation defining the periphery of the or each removable portion is a cut line extending completely through the material of the cover film around the whole of the periphery of the removable portion, then there is no physical connection between the individual removable portion and the remainder of the cover film. The individual removable portion will therefore normally be held in position within the plane of the remainder of the cover film by the associated larger barrier patch to which it is adhered. It is important to note that the or each barrier patch is not secured to the top surface of the tray, but only to the cover film. For the avoidance of any doubt, it should be noted that the or each barrier patch may be larger than, the same size as, or smaller than the associated removable portion and may be shaped and sized to be larger than, the same size as, or smaller than the associated cavity of the tray.

The preferred arrangement of removable portion(s) and barrier patch(es) may incorporate additional tamper evident properties because once a removable portion of the cover film has been released it cannot be easily reattached over the associated cavity. This is because the barrier patch is larger than the overlying removable portion such that in use it overlies a region of the generally planar top surface of the tray extending completely around the periphery of the associated cavity. Once the removable portion and the attached barrier patch have been released, there will be a narrow border of the cover film immediately outside the line of separation defining the periphery of the removable portion. It will be readily appreciated that this narrow border is secured to the periphery of the barrier patch prior to the release of the removable portion. In practice, if the underside of the cover film is covered with peelable adhesive, the narrow border will tend to adhere to the generally planar top surface of the tray. This makes it very difficult to slide the peripheral edge of the barrier patch back between the cover film and the top surface of the tray to reattach the released removable portion over the associated cavity. Tamper evident properties are especially important if the container is used to store and dispense food and medication such as pills, tablets and capsules.

The barrier film can have a further pre-defined cut line or tear line close to one edge thereof to define a removable strip which when removed exposes a location anchorage area of the peelable adhesive on the underside of the cover film, for adhering an edge portion of the cover film to an edge portion of the tray before peeling away the majority of the barrier film and adhering the cover film over the cavities. To assist in the process of adhering the cover film to the top surface of the tray, the tray can have upstanding cover film location means. The cover film can have cooperating means for accurate location of the cover sheet over the tray with the one or more cavities and associated removable portions in register before adhering the cover film to the tray.

Irrespective of whether or not the barrier film includes the removable strip, it will be removed first from a first edge of the cover film and then peeled away from the cover film such that the cover film and the barrier film separate from each other along a removal direction that extends generally from the first edge towards a second, opposite, edge of the cover film. In one arrangement, the tamper-indicating line of separation extends substantially along the removal direction. If the tamper-indicating line of separation is straight it can be substantially parallel to the removal direction. In the case of a more complex tamper-indicating line of separation, e.g., a wavy or zig-zag line, either a substantial part of the tamper-indicating line of separation can be substantially parallel to the removal direction, or a line of best fit through the tamper-indicating line of separation can be substantially parallel to the removal direction, for example. Such a substantial part of the tamper-indicating line of separation or line of best fit can also be substantially parallel to an edge of the cover film, e.g., an edge along which the tamper-indicating line of separation extends and is adjacent to. Some degree of offset with respect to the removal direction can be tolerated while still benefiting from the advantages mentioned below. It has been found that aligning the tamper-indicating line of separation substantially parallel to the removal direction and/or an edge of the cover film can help to prevent separation or tearing when the barrier film is peeled away from the cover film and before the cover film is secured to the generally planar top surface of the tray, e.g., by the exposed layer of peelable adhesive. However, in some arrangements, particularly where the depth of the pre-scored tamper-indicating line of separation or the size and shape of the individual perforations of the pre-perforated tamper-indicating line of separation are determined to provide a satisfactory amount of resistance to separation during removal of the barrier film, the tamper-indicating line of separation can be aligned at any angle to the removal direction, including being perpendicular to it. The type of cover film material can also be an important factor when determining the resistance to separation during removal of the barrier film. For example, a cover film made of a plastics film (e.g., polypropylene) might be more prone to separation or tearing along the tamper-indicating line of separation than a cover film made of a paper sheet, and might therefore require suitable alignment with the removal direction that helps to prevent unwanted tearing when the barrier film is removed or while the cover film is being applied to the generally planar top surface of the tray.

The cover film may have pre-formed lines of separation defining an array of removable portions. The barrier film may also have pre-formed lines of separation defining an array of barrier patches, each barrier patch being associated with a removable portion and being shaped and sized so that in use it overlies one of the cavities.

The cover film may be a metal foil, such as aluminum foil, a metallized polymeric film or paper sheet, a plastics film of single or multiple layer construction, or any combination thereof, depending on the sort of consumer products to be stored and dispensed from the container. The cover film is preferably non-rupturable (except around pre-formed tear lines) so that the consumer products cannot be accidentally or deliberately pushed through the cover film.

The barrier film may be a metal foil, such as aluminum foil, a metallized polymeric film or paper sheet, a plastics film of single or multiple layer construction, or any combination thereof, depending on the sort of consumer products to be stored and dispensed from the container.

The present invention further provides a container for storing and dispensing consumer products, comprising:

- a tray having a generally planar top surface into which has been formed one or more discrete cavities for receiving the consumer products; and
- a seal as described above secured to the generally planar top surface of the seal, e.g., by a layer of peelable adhesive between the cover film that is exposed when the majority of an optional barrier film is peeled away from the cover film along a removal direction.

The container can be a multiple-compartment container for containing and dispensing medication according to a pre-defined dosage regimen, wherein an array of discrete cavities are formed into the generally planar top surface of the tray, the cover film has pre-formed lines of separation defining an array of removable portions, and the optional barrier film has pre-formed lines of separation defining an array of barrier patches, each barrier patch being associated with a removable portion and being shaped and sized so that in use it overlies one of the cavities. The seal can be printed with details of the sequence of the dosage regimen, so that the user can determine the correct sequence of opening and can release the individual removable portions. The individual removable portions of the cover film are released with the generally planar top surface of the tray facing upwards, so that the risk of spilling the medication onto the floor during opening is much reduced over rupturable foil covered blister packs which are generally opened in the inverted position.

To dispense the contents of a cavity, the consumer can simply push down on the associated removable portion with their forefinger. This may require the consumer to release the removable portion from the remainder of the cover film by tearing along the tear lines. In an arrangement where the underlying barrier patch is larger than the associated removable portion then it must also be peeled away from the overlapping region of the cover film. The force needed to release the removable portion is preferably less than is necessary to push the consumer products through a rupturable cover sheet.

The released removable portion is then pushed down into the cavity on top of the consumer products and can be removed through the newly created opening in the cover film by sliding it up the side of the cavity until it can be grasped firmly between forefinger and thumb. If a bridge region is provided, the released removable portion will remain attached to the remainder of the cover film by the bridge region after it has been released and is pushed down into the cavity in a similar manner. The consumer products in the cavity can then be dispensed through the newly created opening in the cover film. Alternatively, if the tray is formed from a suitable (preferably plastics) material such that the one or more cavities are compressible, the contents of a cavity can be dispensed by pushing the consumer products through the cover film from behind.

BRIEF DESCRIPTION OF THE DRAWINGS

The present invention can be even more fully understood with the reference to the accompanying drawings which are intended to illustrate, not limit, the present invention.

DETAILED DESCRIPTION OF THE INVENTION

Although the dispensing container according to the invention is suitable for storing and dispensing a wide range of consumer products, the rest of the specification will concentrate mainly on its use as a multiple-compartment container for organizing and storing mixed medication for subsequent dispensation according to a predefined dosage regimen.

Figure 1:
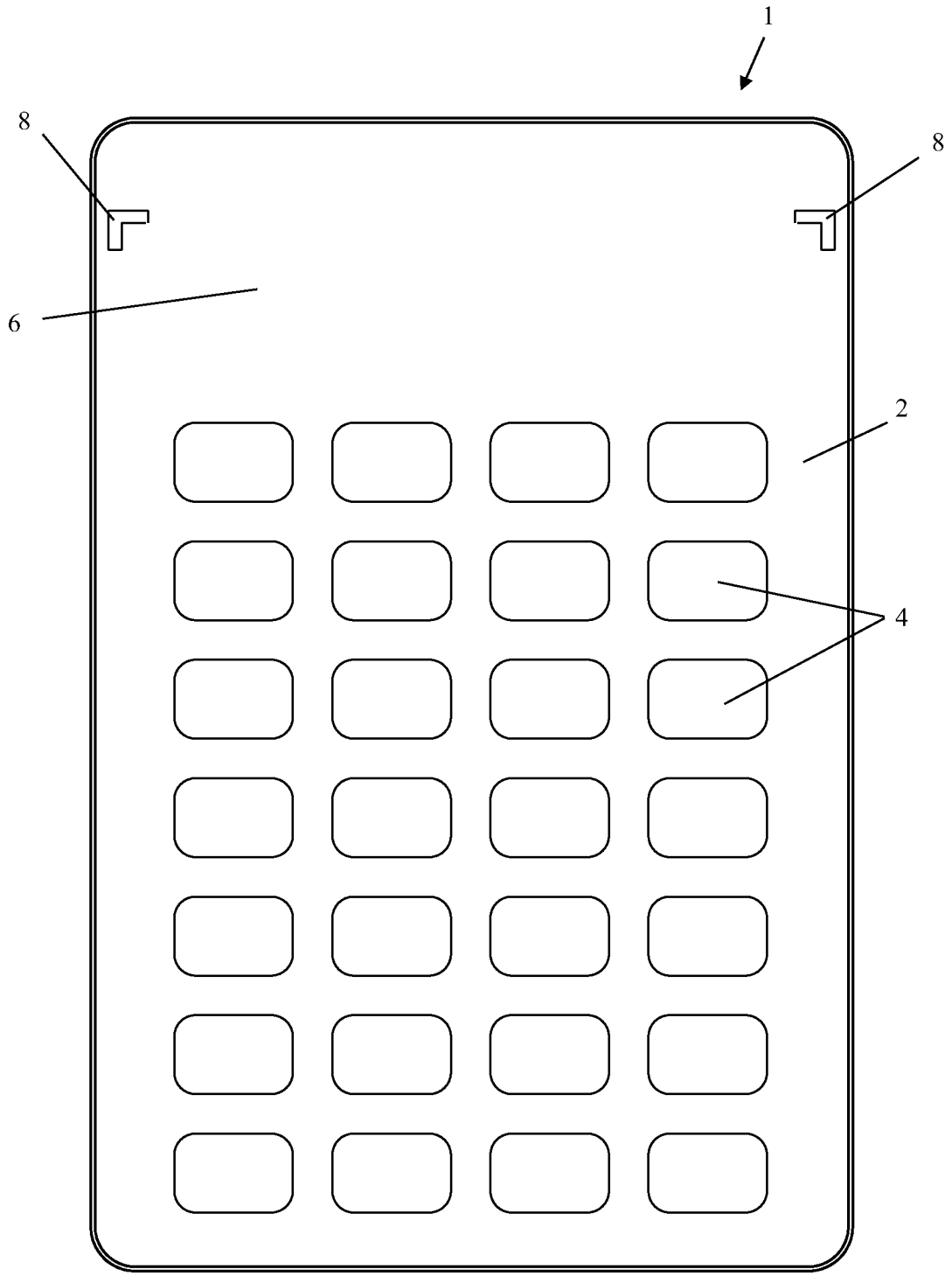
FIG. 1 is a top view of a molded tray of a multiple compartment dispensing container.
Figure 2:
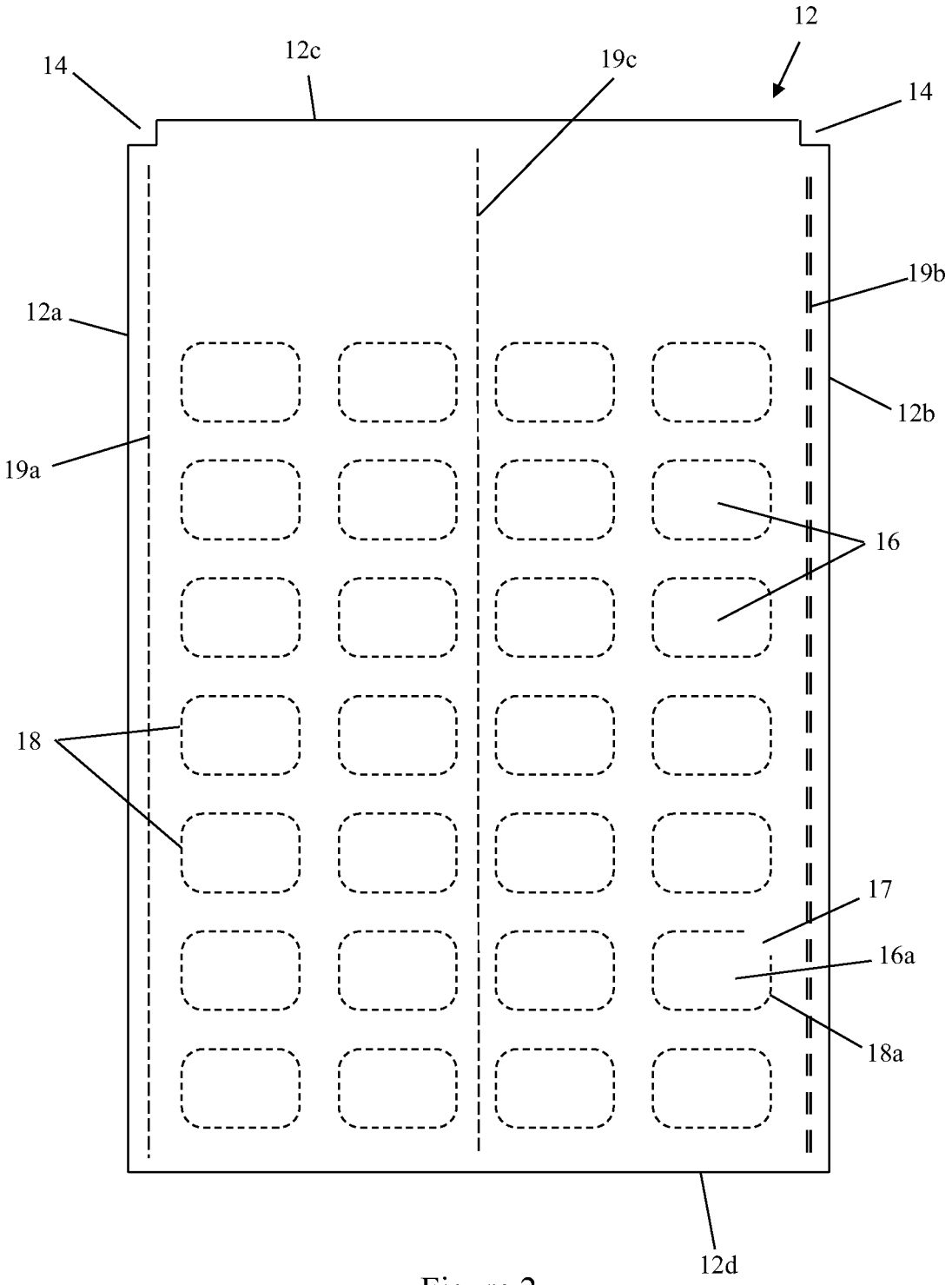
FIG. 2 is a top view of a cover film.
Figure 3:
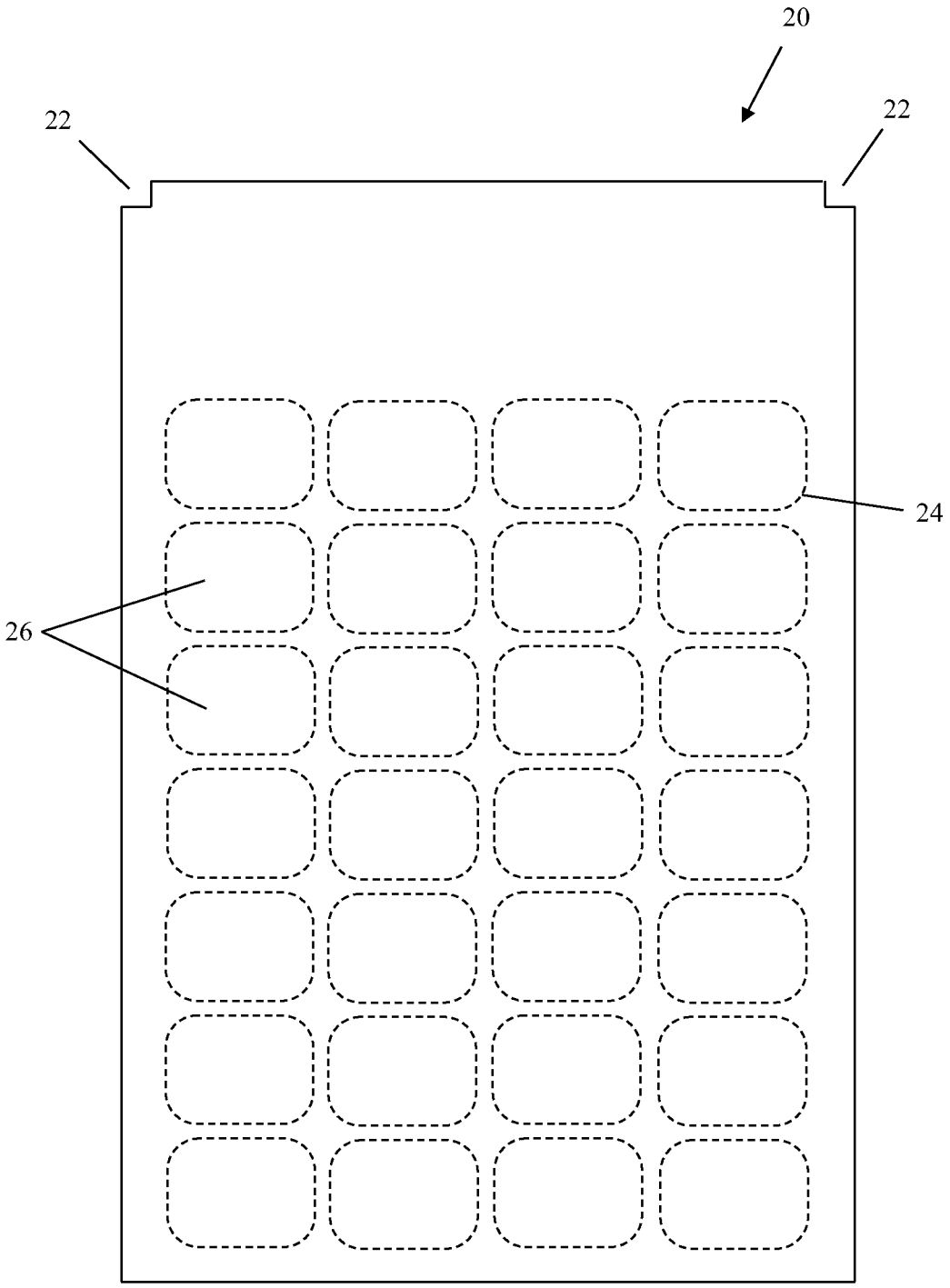
FIG. 3 is a top view of a barrier film to be used in conjunction with the cover film of FIG. 2 to form a seal according to the invention.

Referring to FIG. 1 there is shown a molded tray 1 of a multiple-compartment container. The tray 1 is formed from a sheet of thermoplastic material and may be formed for example by press molding or by vacuum molding. The tray 1 has a generally planar top surface 2 into which has been formed a 4×7 array of discrete cavities 4. It will be readily appreciated that other arrangements of the discrete cavities are possible depending on the particular dosage regimen required.

A flat header portion 6 immediately above the array of cavities 4 is provided for receiving printed information such as a trademark or a pharmacy label. However, in other arrangements this header portion may be omitted completely, and the cover film and barrier film will be sized and shaped accordingly. Close to the top corners of the header portion 6 the tray is provided with two upstanding integrally molded location brackets 8 for the accurate location of a seal 10 in register with the cavities 4.

The seal 10 is of a laminated construction, which can be best understood by reference to FIGS. 2 to 5. The top layer of the seal 10 is the cover film 12 shown in FIG. 2. It is a sheet of smooth and flexible, and preferably transparent, plastics film, the outline of which corresponds generally to the outline of the tray 1 with which it is to be used. A suitable material for the cover film 12 is polypropylene. A pair of location rebates 14 formed in the cover film 12 cooperate with the location brackets 8 for the accurate location of the seal on the tray 1 in precise alignment one with the other.

The cover film 12 includes a 4×7 array of tear-off portions 16 each of which is defined by a pre-perforated tear line 18 that extends completely around the periphery of an underlying cavity 4 in the molded tray 1 when the seal is adhered to the top surface 2 of the tray 1. The pre-perforated tear lines 18 represent predefined lines of weakness in the cover film 12. For the purpose of illustration, one tear-off portion 16*a* is defined by a pre-perforated tear line 18*a* that does not extend completely around the periphery of an underlying cavity 4. The ends of the tear line 18*a* are separated by a bridge region 17 so that the tear-off portion 16*a* remains attached to the cover film 12 even when the tear line 18*a* is torn.

The cover film 12 includes a first tamper-indicating pre-perforated tear line 19*a* adjacent the left edge 12*a* and a second tamper-indicating pre-perforated tear line 19*b* adjacent the right edge 12*b*. For the purpose of illustration, the second tamper-indicating pre-perforated tear line 19*b* is shown as a pair of closely spaced, parallel pre-perforated tear lines. The cover film 12 also includes a third tamper-indicating pre-perforated tear line 19*c* between two adjacent columns of tear-off portions 16. The tamper-indicating pre-perforated tear lines 19*a*-19*c* represent predefined lines of weakness in the cover film 12 providing tamper evident properties and extend substantially to the upper and lower edges 12*c*, 12*d* of the cover film 12. Although the tamper-indicating pre-perforated tear lines 19*a*-19*c* are shown as straight lines, it will be readily appreciated that other shapes are possible, e.g., wavy or zig-zag lines.

The first and second tamper-indicating pre-perforated tear lines 19*a*, 19*b* extend along the left and right edges 12*a*, 12*b*, respectively. They are positioned close to the respective edge of the cover film 12, e.g., spaced about 1 or 2 millimeters from the edge, so that the cover film will tear or separate along the respective tamper-indicating tear line if a blade or other sharp object penetrates only a short distance between the cover film and the top surface 2 of the tray.

Although not shown, additional tamper-indicating pre-perforated tear lines can also extend adjacent the upper and lower edges 12*c*, 12*d* of the cover film 12 and between two adjacent rows of tear-off portions 16, for example. A tamper-indicating pre-perforated tear line can also be defined by a plurality of straight or curved line segments that close in a loop to define a closed polygonal tear line. For example, the tamper-indicating pre-perforated tear line can extend completely around the periphery of the cover film 12 along the left, top, right and bottom edges 12*a*-12*c* to enclose the 4×7 array of tear-off portions 16.

Figure 4:
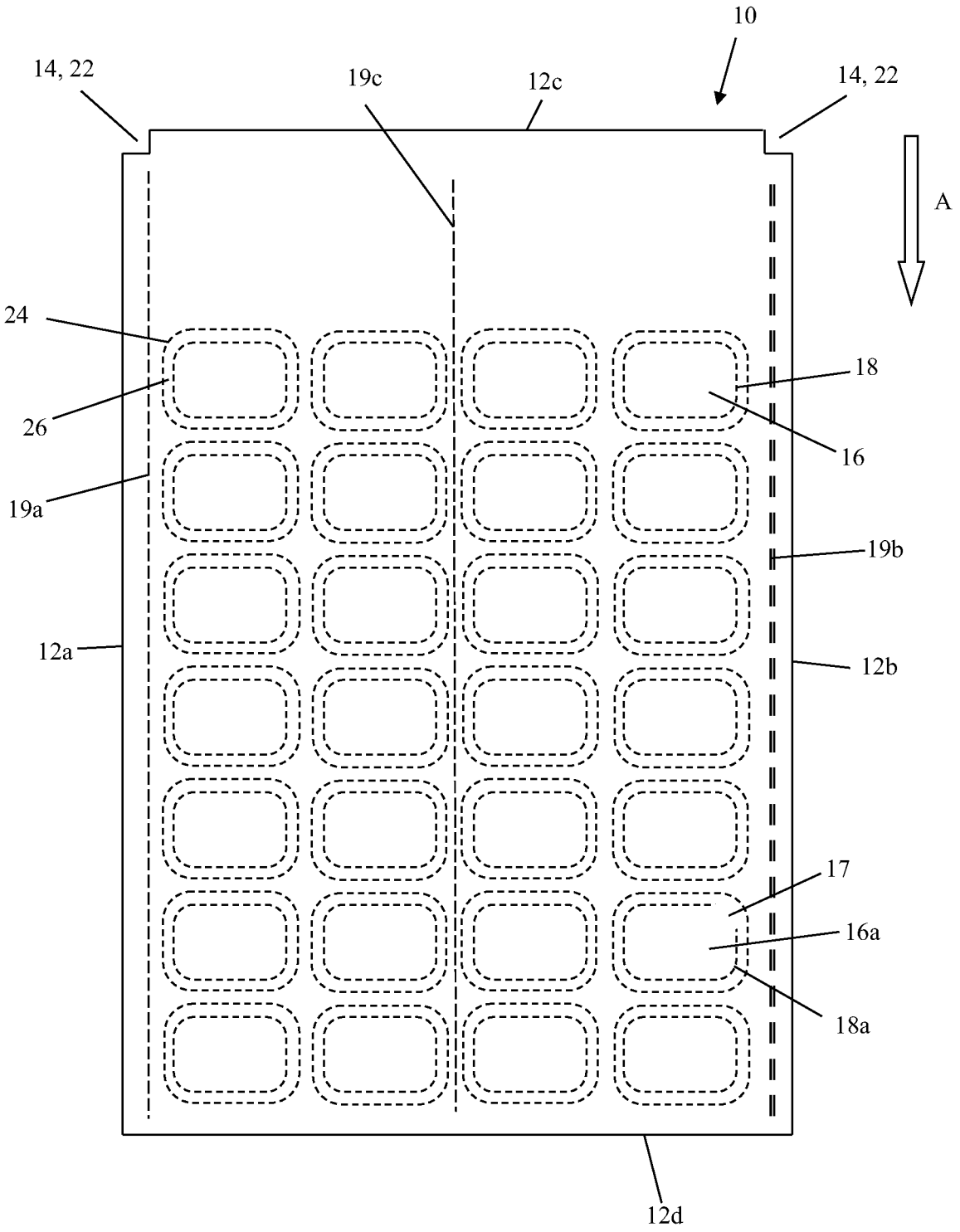
FIG. 4 is a top view of a seal according to the invention where the cover film of FIG. 2 has been secured to the barrier film of FIG. 3.
Figure 5:
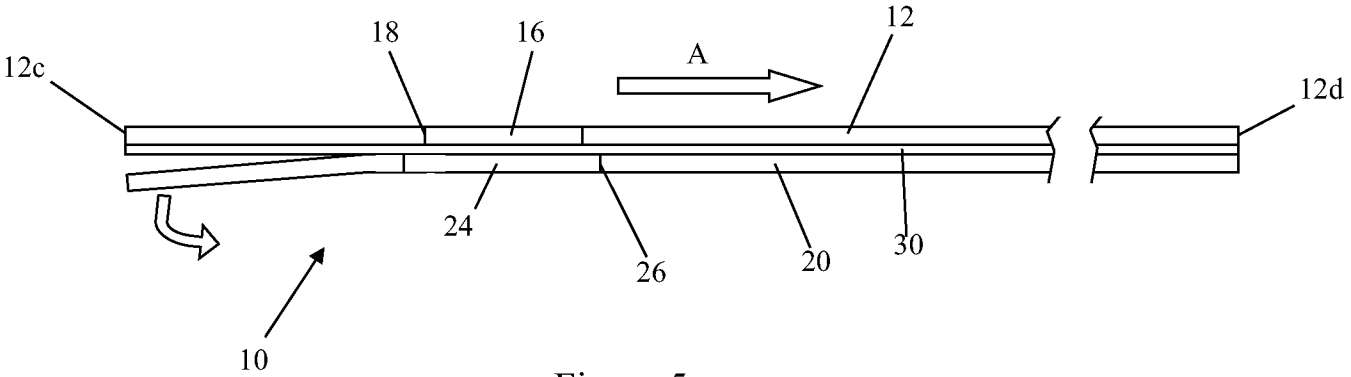
FIG. 5 is a side view of the seal of FIG. 4 showing how the barrier film is peeled away from the cover film.

The entire underside of the cover film 12 is coated with a layer of peelable adhesive 30 and is adhered to a barrier film 20 shown in FIGS. 4 and 5. The barrier film 20 is a sheet of smooth and flexible, and preferably transparent, plastics film, the outline of which corresponds generally to the outline of the cover film 12 with which it is to be used. A suitable material for the barrier film 20 is polypropylene.

The barrier film 20 has two location rebates 22 that register with the location rebates 14 of the cover film 12. Pre-perforated tear lines 24 define the outer peripheries of a 4×7 array of vapor-impermeable barrier patches 26, which in use are adhered to the underside of the respective tear-off portions 16 and lie directly over the respective cavities 4 of FIG. 1. The barrier patches 26 are slightly larger than the tear-off portions 16 such that in use they overly a region of the generally planar top surface 2 of the tray 1 extending completely around the periphery of the respective cavities 4. However, the barrier patches may be the same size as, or smaller than, the tear-off portions 16.

It will be readily appreciated that the pre-perforated tear lines 18, 18*a* in the cover film 12 can be replaced with cut lines that extend completely through the cover film material, or by pre-scored tear lines. Similarly, the perforations 24 in the barrier film 20 can be replaced with cut lines that extend completely through the barrier film material, or by pre-scored tear lines. The tamper-indicating perforations 19*a*-19*c* can be replaced with pre-scored tear lines. The cut lines or tear lines will normally be formed using a die cutter after the cover film 12 and the barrier film 20 have been secured together to form the laminated seal 10. A pair of rotary die cutters can be used with one die cutter forming cut lines or tear lines in the cover film 12 from one side of the seal 10 and the other die cutter forming cut lines or tear lines in the barrier film 20 from the other side of the seal. In the case of cut lines or tear lines, care must be taken to ensure that the overall physical integrity of the seal is maintained. For example, in practice it will often be the case that the cut lines or tear lines formed in the cover film 12 will extend slightly into the layer of peelable adhesive 30, but the respective rotary die cutter is preferably set such that the cut lines or tear lines do not extend into the barrier film 20 to any appreciable extent.

In use, a pharmacist, a caregiver, or the patient himself or herself, will distribute medication in the form of pills, tablets, and/or capsules between the 28 discrete cavities 4 formed in the top surface 2 of the tray 1 in accordance with a seven-day or 28-day dosage regimen. For example, the seven rows of cavities represent the days of the week, and the four columns can represent either four consecutive weeks of a 28-day dosage cycle, or four different dosage times for each day of treatment. In the latter case, the first column can represent breakfast-time, the second column lunchtime, the third column early evening and the fourth column bedtime. Either a uniform medication can be distributed through the 28 discrete cavities, or a varying mixture of medications can be placed into each cavity.

When the cavities 4 have been properly filled the cover film 12 is secured to the top surface 2 of the tray. The barrier film 20 and cover film 12 are separated first at the upper edge 12*c* and the majority of the barrier film 20 is then peeled away from the cover film 12 along a removal direction towards the lower edge 12*d*—the removal direction is indicated in FIGS. 4 and 5 by arrow A—to expose the layer of peelable adhesive 30. The barrier film 20 will tear along the pre-perforated tear lines 24 such that the barrier patches 26 remain adhered to the underside of the cover film 12.

The tamper-indicating pre-perforated tear lines 19*a*-19*c* extend substantially parallel to the removal direction.

The cover film 12 is secured to the top surface 2 of the tray 1 by the layer of peelable adhesive 30 with the barrier patches 26 overlying the respective cavities 4.

If an attempt is made to peel the cover film 12 away from the top surface 2 of the tray, e.g., by inserting a blade underneath the left edge 12*a* of the cover film, the cover film will intentionally tear or separate along the tamper-indicating pre-perforated tear line 19*a*. A torn tear line provides a clear visual indication that the cover film 12 has been tampered with.

Figure 6:
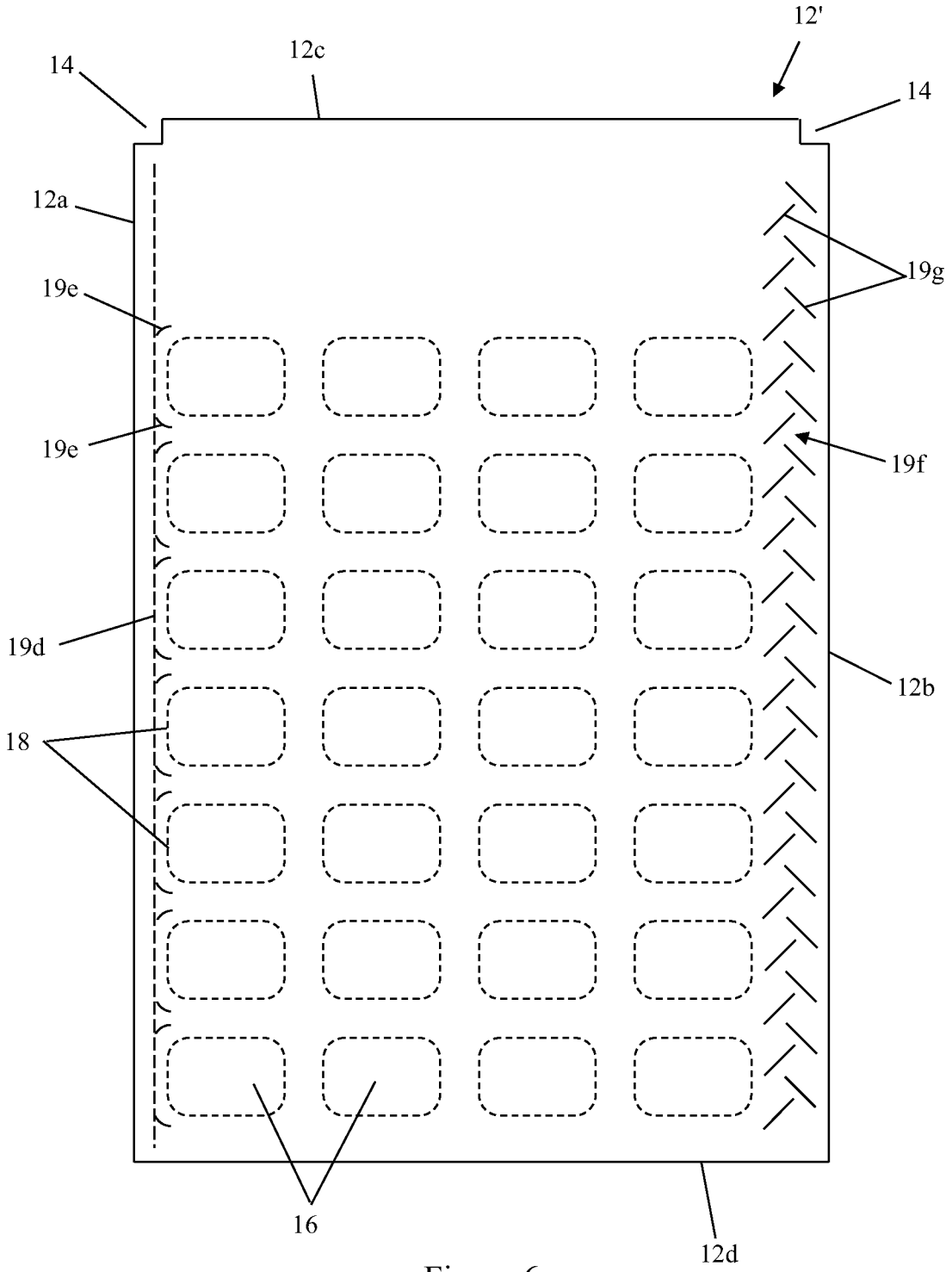
FIG. 6 is a top view of an alternative cover film.

An alternative cover film 12' is shown in FIG. 6. It is a sheet of smooth and flexible, and preferably transparent, plastics film, similar to the cover film 12 shown in FIG. 2. Like parts have been given the same reference number and are not described further here.

The cover film 12' includes a tamper-indicating pre-perforated tear line 19*d* adjacent the left edge 12*a*. The tamper-indicating pre-perforated tear line 19*d* is similar to the first tamper-indicating pre-perforated tear line 19*a* shown in FIG. 2 but additionally includes curved cut lines 19*e* that extend from the straight tear line and partly around the corners of the adjacent removable portions 16. These additional cut lines 19*e* help to prevent a blade or other sharp object, if inserted from the edge of the dispensing container, from lifting the cover film away from the part of the tray that surrounds a discrete cavity. It will be clear that if the cover film is lifted in this way, it might be possible to create an opening underneath the cover film between the discrete cavity and the outside edge that would permit the contents of the cavity to be tampered or interfered with. The tamper-indicating pre-perforated tear line 19*d* extends along the left edge 12*a* and is spaced about 1 to 2 millimeters from it so that it will tear or separate if a blade or other sharp object penetrates only a short distance between the cover film and the top surface of the tray.

A tamper-indicating line of separation 19*f* extends along the right edge 12*b* of the cover film 12'. The tamper-indicating line of separation 19*f* comprises a plurality of individually spaced cut lines 19*g* that are arranged in a zig-zag pattern along the right edge 12*b*. The cut lines 19*g* are about 4 to 6 millimeters long and are spaced about 1 to 2 millimeters from the right edge 12*b*. The cover film 12' will tear between the cut lines 19*g* of the tamper-indicating line of separation 19*f* if a blade or other sharp object penetrates only a short distance between the cover film and the top surface of the tray.

A cover film can have different types of tamper-indicating lines of separation depending on the overall design of the cover film and the amount of space that is available outside of the removable portion(s) or between the removable portion(s) and the edges of the cover film. For example, in the cover film 12' shown in FIG. 6, there is more between the removable portions and the right edge 12*b* than there is between the removable portions and the left edge 12*a*. In other words, there is more space adjacent the right edge 12*b* in which to accommodate the zig-zag pattern of cut lines 12*g* that defines the tamper-indicating line of separation 12*f*.

The present invention can include any combination of these various features or embodiments above and/or below as set-forth in sentences and/or paragraphs. Any combination of disclosed features herein is considered part of the present invention and no limitation is intended with respect to combinable features.

The entire contents of all references cited in this disclosure are incorporated herein in their entireties, by reference. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether such ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof

What is claimed is:

1. A seal for sealing a container for storing and dispensing consumer products, the seal comprising:

a cover film having an underside, a top side, and pre-formed lines of separation defining an array of removable portions; and a layer of adhesive coated on the underside of the cover film, wherein the cover film includes a plurality of pre-formed tamper-indicating lines of separation formed in a part of the cover film that lies outside the array of removable portions, including a first tamper-indicating line of separation extending along and adjacent to a first edge of the cover film, and a second tamper-indicating line of separation extending along and adjacent to a second edge of the cover film, the second edge being opposite the first edge, wherein the array of removable portions comprises outer removable portions adjacent the first edge of the cover film, each of the outer removeable portions having two outer corners adjacent the first edge of the cover film, wherein the first pre-formed tamper-indicating line of separation comprises a pre-perforated straight tear line and curved cut lines that extend from the straight tear line and partly around the outer corners of the outer removable portions, and wherein the second pre-formed tamper-indicating line of separation comprises a plurality of individually spaced cut lines that are arranged in a zig-zag pattern along the second edge of the cover film.

2. The seal of claim 1, wherein each tamper-indicating line of separation is formed by a pre-scored tear line, a pre-perforated tear line, or both.

3. The seal of claim 1, wherein the layer of adhesive has a top side in contact with the underside of the cover film, and a bottom side, and the seal further comprises a barrier film secured to the cover film by contact with the bottom side of the layer of adhesive, the barrier film having pre-formed lines of separation defining an array of peripheries of barrier patches including one barrier patch per removable portion.

4. The seal of claim 3, wherein each barrier patch is larger than the respective removable portion.

5. The seal of claim 3, wherein part of the barrier film is adapted to be removed from the cover film along a removal direction of the seal to expose part of the bottom side of the layer of adhesive, the first and second tamper-indicating lines of separation extending substantially along the removal direction.

6. A container for storing and dispensing consumer products, comprising:

a tray having a generally planar top surface into which has been formed an array of discrete cavities for receiving consumer products; and the seal of claim 1 secured to the generally planar top surface of the tray, the seal sealing the array of cavities to retain consumer products in the array of cavities, the cover film including a removable portion per cavity.

7. The container of claim 6, in the form of a multiple-compartment container for containing and dispensing medication according to a pre-defined dosage regimen and containing medication to be used according to the pre-defined dosage regimen.

8. The container of claim 6, wherein the seal is secured to the generally planner top surface of the tray by the layer of adhesive.

9. The container of claim 6, wherein the seal further comprises a barrier film secured to the cover film by a layer of adhesive, the barrier film defining an array of barrier patches including one barrier patch per removable portion, each barrier patch being shaped and sized so that it overlies an associated cavity.

10. The container of claim 9, wherein the seal is secured to the generally planner top surface of the tray by the layer of adhesive.

11. A method of making the container of claim 6, comprising removing part of the barrier film from the cover film along a removal direction of the seal, and then adhering the seal to the generally planar top surface of the tray, wherein the first and second tamper-indicating lines of separation extend substantially along the removal direction.

* * * * *